United States Patent [19]

Savioli

[11] 4,004,492

[45] Jan. 25, 1977

[54] DISINTEGRABLE CARTRIDGE LINK

[75] Inventor: Giulio V. Savioli, Davenport, Iowa

[73] Assignee: The United States of America, Washington, D.C.

[22] Filed: Sept. 17, 1975

[21] Appl. No.: 614,284

[52] U.S. Cl. ..... 89/35 A

[51] Int. Cl.[2] ..... F42B 39/08

[58] Field of Search ..... 89/35 R, 35 A; 221/25, 221/69, 70, 71, 72, 74, 76, 84, 85

[56] References Cited

UNITED STATES PATENTS 2,388,943 11/1945 Alter ..... 89/35 A

*Primary Examiner*—Stephen C. Bentley

*Attorney, Agent, or Firm*—Nathan Edelberg; Harold H. Card, Jr.; Robert O. Richardson

[57] ABSTRACT

An articulated belt for supporting and moving a plurality of elongate parallel objects such as gun cartridges disintegrates just as the cartridges are extracted therefrom at the gun. The belt consists of separate links, each link comprising two interlocking elements, one of which applies holding force to a cartridge while the other is in tension resulting from pulling force applied to feed the cartridges to the gun. The cartridge-holding element has no tensile force applied to it by the tension element.

5 Claims, 3 Drawing Figures

DISINTEGRABLE CARTRIDGE LINK

GOVERNMENT INTEREST

The invention described herein may be manufactured and/or used by or for the Government for governmental purposes without the payment of any royalty thereon.

BACKGROUND OF THE INVENTION

Modern rapid-fire automatic weapons involve several technical problems in feeding ammunition to such weapons in the quantity and at the rate required during sustained gunfire bursts. Where belt feed systems are used, disengagement of cartridges from the belt must be rapid and reliable, requiring the least possible mechanical operations and the most positive, trouble-free performance characteristics.

The belts used in such systems are required to provide great strength, as long feedlines of heavy-caliber ammunition often are fed to the weapon by devious paths, sometimes nearly vertical, and all the pulling force required to move the belt is transmitted through its individual links. The severe tensile loads transmitted through the belt must not distort the links so as to either loosen or tighten the holding force applied to the cartridges by each link. Thus, loosening of a link may cause a cartridge to fall out of the belt which usually results in separation of the belt at the location of the lost cartridge. Bending of a link such as would tighten its grip on a cartridge or misalign the same in the belt can cause jamming of the weapon due to inability to extract the cartridge from the belt, whereupon the weapon becomes useless.

SUMMARY OF THE INVENTION

The invention in this case is essentially a link assembly 10 for use in disintegrable cartridge belts or the like. Link assembly 10 includes a cartridge holding element 12 and a tension-transmitting element 14, shown in the assembled state in FIG. 1 operatively related to a cartridge 16 suggested by broken lines. Element 12 has a planar center portion 18 and four elongate projecting arms, 20 and 21 adapted to engage cartridge 16 in firm but releasable gripping relationship.

Link element 14 has an elongate curved center portion 22 with oppositely projecting tabs 24 and 26 on either side thereof, and retaining wall portions 28 and 30 integrally formed or otherwise affixed to portion 22 and each of tabs 24 and 26, respectively.

At the opposite ends of portion 22, link element 14 has a flanged projection 32 and a hook-like portion 34. Flange 32 has an aperture 36 therethrough for engagement with a hook on another adjoining link assembly operatively related to assembly 10. When cartridge 16 is extracted from between arms 20 and 21, element 14 drops off element 12 and both link elements separate.

DESCRIPTION OF THE PREFERRED EMBODIMENT

Figure 1:
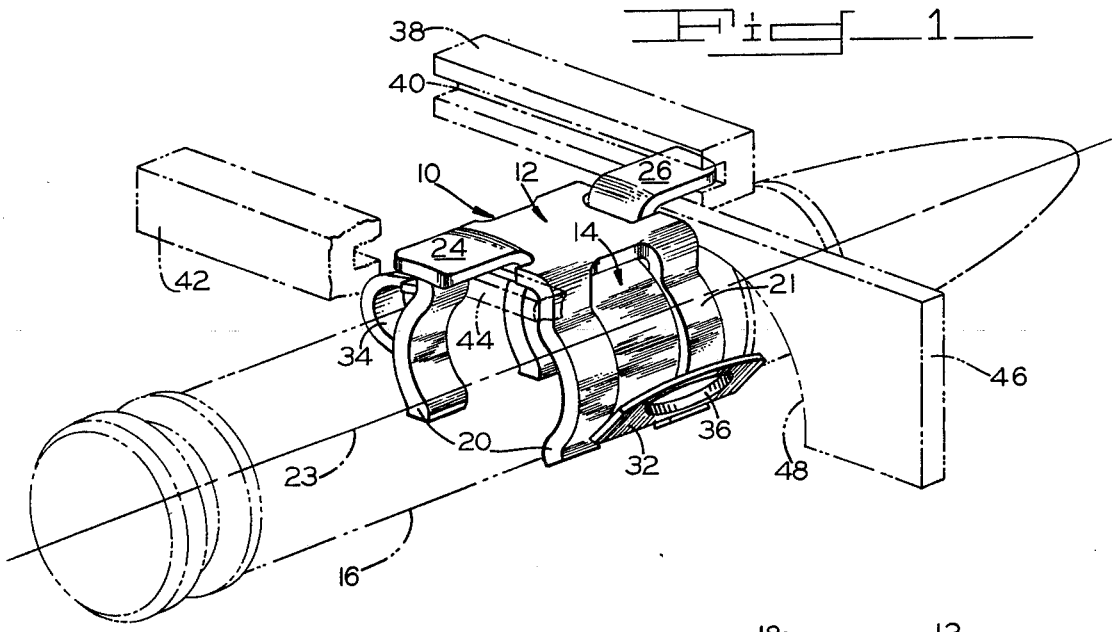
FIG. 1 is a general perspective view, partly broken away, showing the inventive structure operatively related to a cartridge.
Figure 2:
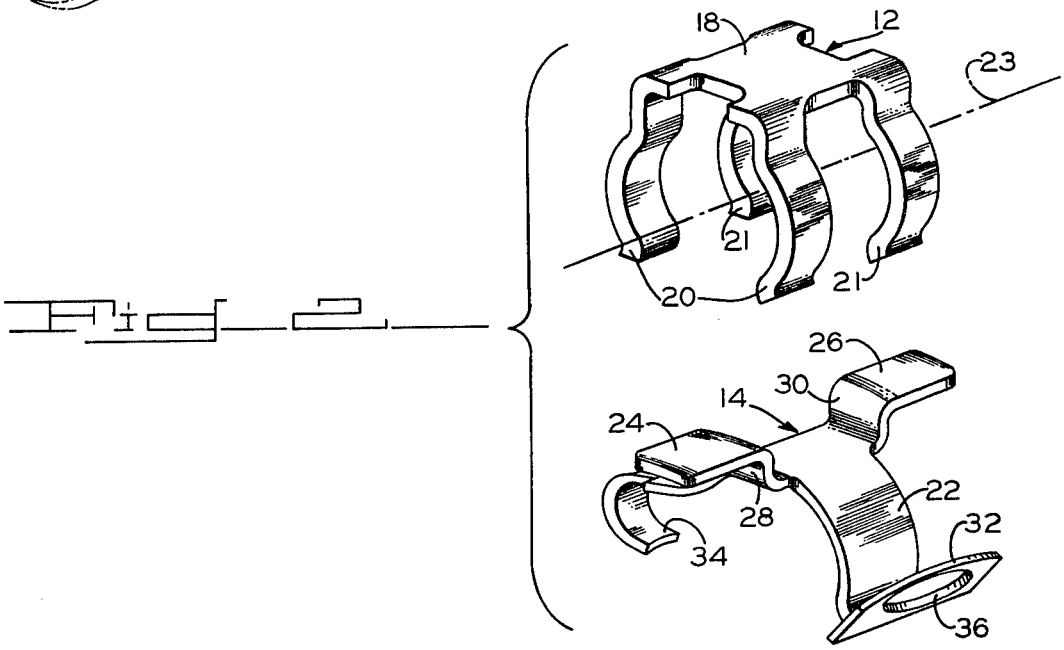
FIG. 2 is an isolated perspective view of disassembled structure shown assembled in FIG. 1.
Figure 3:
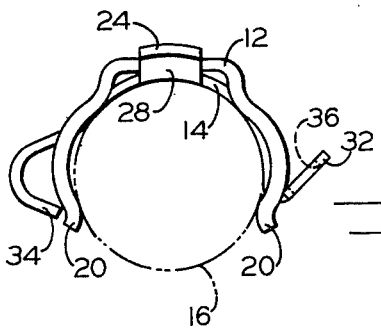
FIG. 3 is an end elevation view of the structure shown in FIGS. 1 and 2.

Referring to FIG. 1, link assembly 10 may be seen to comprise cartridge holding element 12 releasably secured in nesting relationship with tension element 14 and operatively related to cartridge 16. Holding element 12, as further seen in FIGS. 2 and 3, has a substantially planar center portion 18 and a plurality of elongate projections 20 and 21 integrally formed or otherwise secured to portion 18. Projections 20 and 21 are resiliently deformable and arranged in pairs so that arms 20 and 21 are substantially aligned in oppositely confronting relationship equidistantly on either side of a center axis 23 corresponding to the longitudinal axis of cartridge 16 when element 12 is operatively joined to the cartridge as in FIG. 1. Thus, arms 20 are of arcuate shape, each defining a portion of a circle. Arms 21 are similarly related and shaped as arms 20, but are spaced apart from arms 20 a distance preferably not less than the diameter of the circle defined in part by the arcuate portions of arms 20 and arms 21.

Tension element 14 has a curved center portion 22 with a flanged projection 32 at one end thereof and engagement means comprising a hook 34 at the other. Flange 32 has an aperture 36 through the same for engagement with another hook formed on another link assembly corresponding to assembly 10 and operatively related thereto for holding adjoining cartridges in a series of cartridges forming an ammunition belt.

Arms 20 and 21 are dimensioned so that, in the static undisturbed state of rest, the projections are slightly less distance apart than the diameter of cartridge 16. Thus, when element 12 is engaged in holding relationship with the cartridge, arms 20 and 21 are deformed radially outwardly from the longitudinal axis of the cartridge sufficiently to cause a spring reaction force in the arms to grip the contacting surface portions of the cartridge.

However, before element 12 is positioned in the foregoing relationship with the cartridge, element 14 is positioned in nesting relationship with element 12 as seen in FIG. 1. Thus, link element 14 has oppositely confronting retainer wall portions 28 and 30 in spaced-apart relationship and secured or formed on opposite sides of portion 22. The distance between wall portions 28 and 30 is only slightly in excess of the length of elongate planar portion 18 of element 12, whereby in their nesting relationship, walls 28 and 30 prevent relative linear movement between elements 12 and 14 longitudinally. Also secured to or formed on wall portions 28 and 30 are tabs 24 and 26 respectively. These tabs function as guide means when the belt formed by a plurality of cartridges 16 operatively engaging link assemblies 10 is moving toward a gun being fired.

Thus, as seen in FIG. 1, a link guide track 38 having a center gap 40 formed therein is provided for engagement of tab 26 within the gap. The tab is slidably movable relative to the stationary track 38, but is otherwise restrained against vertical movement or angular displacement. It will be understood that another track 42 parallel to and similar to track 38 is provided for operative connection with tab 24, and functions in the same manner as described for track 38.

Mounted on or near the gun (not shown) for which cartridge 16 is intended is a pair of identical cartridge strippers 44 and 46 each having a thin wedge portion so aligned with the gaps in tracks 38 and 42 as to receive and guide tabs 24 and 26 just as the tabs are about to leave the tracks at the end of their movement toward the gun. The strippers each have a rounded bearing surface suggested by surface 48 on stripper 46. Once the wedge portions of strippers 44 and 46 engage the undersurfaces of tabs 24 and 26, respectively, any further movement of link assembly 10 laterally toward the strippers will cause wedging force from the strippers to push cartridge 16 downwardly in the view shown by FIG. 1, while link element 14 slides across the top surfaces of the strippers, carrying link element 12 along with it. After reaching the far end of stripper 46, for example, element 14 will fall freely through space along with element 12, preferably into a collection chute where the disintegrated elements can be recycled for further use in another ammunition belt.

While the inventive concept has been illustratively described in a preferred form hereinabove, it will be understood that the teachings in this case can be incorporated in other structural forms without departing substantially therefrom.

I claim:

1. An articulated belt for conveying a plurality of elongate objects, said belt including:

a series of links each consisting of a holding element for engaging one of said objects and a tension element for nesting engagement with said holding element, said holding element having a substantially planar body portion and at least a pair of flexible arcuate arms carried by said body portion on opposite sides thereof for holding engagement with one of said objects and defining therebetween a space for receiving said tension element, said tension element having oppositely directed tab means formed thereon adapted to engage a pair of spaced-apart guide tracks, and said tension element further having releasable securing means on either end thereof for securing said tension element to similar tension elements in an adjoining link in force-transmitting relationship so that all such force is transmitted directly through said tension element while all said gripping force is transmitted through said holding element.

2. The belt of claim 1 wherein said tension element includes a curved body portion carrying an angled apertured tab for connection with a similar link.

3. The belt of claim 2 wherein said body portions of said tension element carries on the side opposite said apertured tab a hook member for connection to another link having a similarly apertured tab.

4. The belt of claim 3 wherein the body portion of said holding element is recessed on opposite sides and said tension element tabs extend through said recesses and above the top surface of said holding element whereby longitudinal movement of said tension element is minimized when assembled with said holding element.

5. The belt of claim 4 wherein said tabs of the tension element are guide tabs and are offset laterally and extend in the same plane beyond the sides of said holding element body portion.

* * * * *